United States Patent [19]

Wright

[11] Patent Number: 4,630,743

[45] Date of Patent: Dec. 23, 1986

[54] TAMPER INDICATING CHILD RESISTANT CLOSURE

[75] Inventor: David M. Wright, Evansville, Ind.

[73] Assignee: Sunbeam Plastics Corporation, Evansville, Ind.

[21] Appl. No.: 656,472

[22] Filed: Oct. 1, 1984

[51] Int. Cl.[3] ..... B65D 55/02

[52] U.S. Cl. ..... 215/216; 215/253

[58] Field of Search ..... 215/216, 251, 252, 253, 215/258

[56] References Cited

U.S. PATENT DOCUMENTS

| | | | |
|---|---|---|---|
| 4,413,743 | 11/1983 | Summers | 215/216 |
| 4,456,136 | 6/1984 | Palsson | 215/216 |
| 4,471,878 | 9/1984 | Davis et al. | 215/216 |

*Primary Examiner*—George T. Hall
*Attorney, Agent, or Firm*—Irvin L. Groh

[57] ABSTRACT

A tamper indicating and child resistant package including a screw-type closure for use with a container having a threaded neck. The container is equipped with lock members along the threaded neck and a loading ramp carried on the threaded portion of the neck. The closure has concentric inner and outer skirts depending from the top and a lock tab depending from the outer skirt. A T-shaped tamper indicating means is frangibly attached to the outer skirt and to the inner skirt by means of shear webs. The tamper indicating means has a riding ramp along the inner periphery of the inner skirt to engage the loading ramp during application of the closure to the container to avoid premature removal of the tamper indicating means.

17 Claims, 4 Drawing Figures

TAMPER INDICATING CHILD RESISTANT CLOSURE

This invention relates to screw-type closures for containers which are both child resistant and tamper indicating.

A variety of screw-type child-proof or child resistant closures and containers have been provided which require two distinct operations to achieve opening. It is also desirable to have such closures be tamper proof or tamper indicating so that any attempt to open the container once it has been filled, is indicated by some means which can be readily observed. Also, it is desirable that the child resistant feature remains operable for repeated opening and closing procedures whereas the tamper indicating arrangement is required to operate only the first time the container is opened.

It is an object of the invention to provide a closure and container arrangement which is both child resistant and tamper indicating.

The tamper indicating and child resistant package contemplated by the present invention includes a screw-type closure on the neck of a container in which the closure has a disc shaped top with concentric inner and outer walls depending from the top. The inner wall has threads which engage complementary threads on the neck of a container. A lock element is formed on the outer wall of the closure for engagement with a lock member formed integrally with the container immediately below the threads. The lock element engages the lock member to prevent rotation beyond a predetermined point upon unscrewing of the closure in an opening direction. Opening of the container is accomplished by squeezing radially inwardly at opposed points on the closure which causes the lock element to move radially outwardly and pass the lock member on the container during opening rotation. A tamper indicating means is detachably connected to the outer wall and includes an additional stop element similar to the first stop element which engages the lock member on the container unless it is removed. To insure that the additional lock element does not move radially outwardly upon squeezing the diametrically opposed points, the tamper indicating element is attached also to the inner wall of the closure to maintain the inner and out walls adjacent to the additional lock element in fixed spaced relationship to each other. This requires the removal of the tamper indicating element so that squeezing the diametrically opposed points will accomplish an opening condition in which the primary lock element is moved radially outwardly for opening rotation of the closure.

A preferred embodiment of the invention is disclosed in the drawings in which.

Figure 1:
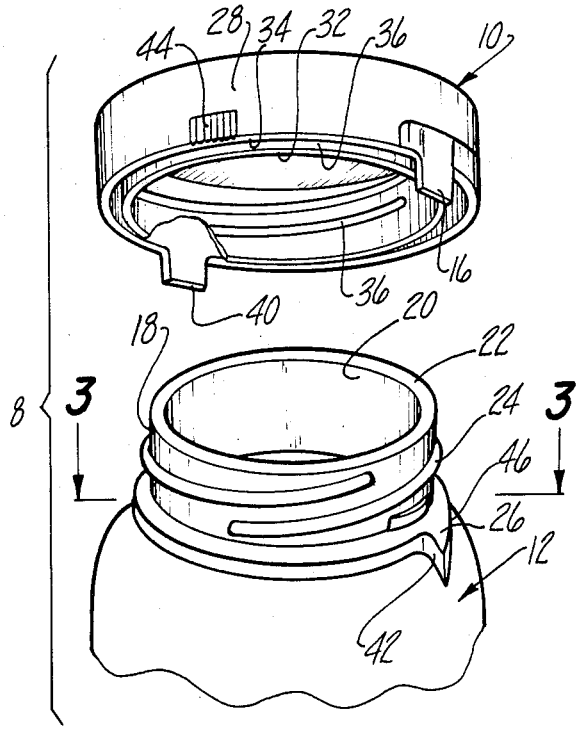
FIG. 1 is an exploded perspective view of the closure and container embodying the invention.

The child resistant and tamper indicating closure and container arrangement 8 of the present invention includes a one-piece plastic closure 10 and a container 12 which preferably is made of glass or plastic. The basic closure arrangement is of the child resistant type in that it requires two dissimilar motions in order to bring about a removal of the closure 10 from the container 12. In the present instance, the basic closure requires squeezing and simultaneous rotation of the closure in order to remove it from the container. Reapplication of the closure 10 to the container 12 is accomplished by a single form of motion, that is, by threading or rotating the cap onto the container.

In addition to the child resistant features, the closure 10 and container 12 include tamper indicating features in which a tamper indicating means indicated generally at 16 requires removal before the child resistant mechanism can be brought into operation. Absence of the tamper indicating means gives evidence that the container has previously been opened or at least put into a condition in which it could be opened.

The closure 10 is applied to the neck 18 of the container 12. The neck 18 forms an opening 20 surrounded a sealing lip 22. Screw threads 24 formed on the exterior of the neck 18 and a lock member 26 is molded or formed integrally with the neck at a point immediately below the threads 24.

The basic closure portion for closing the opening 20 in the container 12 is formed by a cap portion 28. The cap portion 28 includes a disc-shaped top 30 having the inner wall or skirt 32 and a concentric outer wall or skirt 34. The walls 32 and 34 are spaced to form an annular groove 36. The inner wall 32 is provided with threads 36 which are complementary to the threads 24 on the closure neck 18 and are the means by which the closure 10 is maintained on the container 12.

Figure 2:
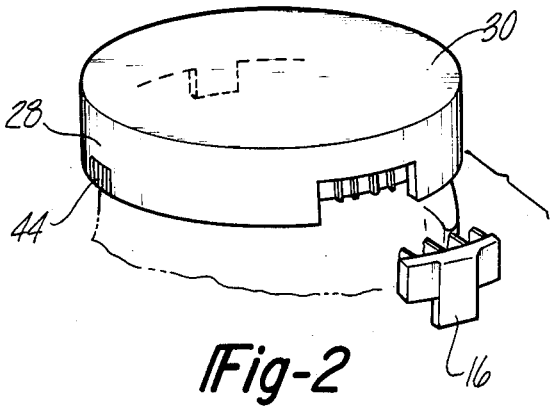
FIG. 2 is a perspective view of the closure and a part of the container illustrating removal of the tamper indicating element.
Figure 3:
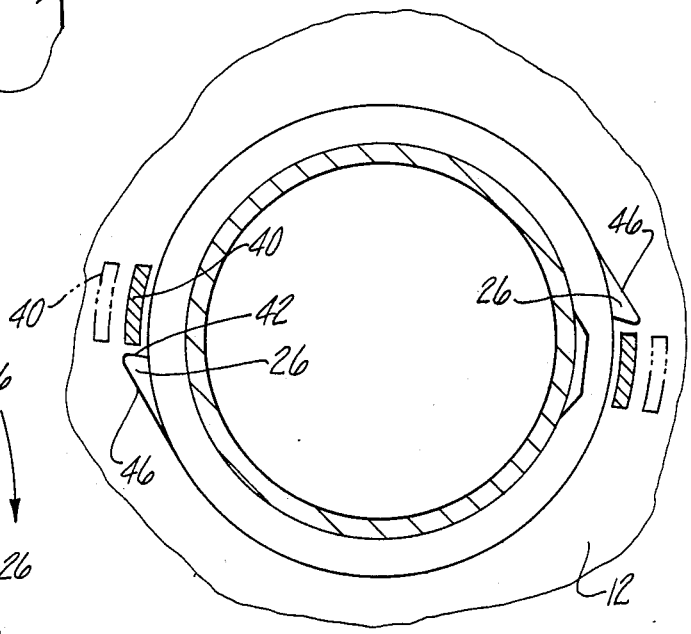
FIG. 3 is a cross-sectional view taken along line 3—3 in FIG. 1.
Figure 4:
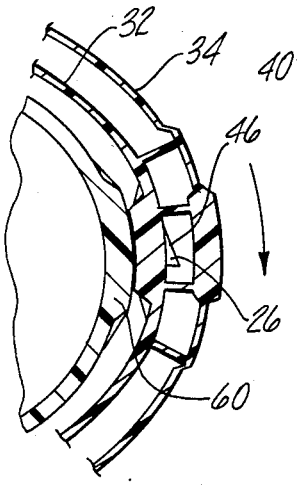
FIG. 4 is a partial cross-sectional view showing the relationship of the closure and container upon applying the closure to the container.

The outer wall 34 of the cap portion 28 is provided with a lock element 40 which in the closed position of the cap portion 28 on the container 12 is circumferentially aligned with the lock member 26 so that unscrewing or opening rotation of the cap portion 28 is obstructed by the engagement of the lock element 40 with a lock surface 42 forming a portion of the lock member 26. To place the cap portion 28 in condition for removal, it is necessary to deflect the outer wall 34 radially inwardly. This is accomplished by squeezing the outer wall of the cap portion 28 at diametrically spaced points indicated at 44 in FIG. 2. This causes the lock elements 40 to flex radially outwardly an amount sufficient to clear the lock surface 42 so that the cap portion 28 can be rotated by maintaining a grip on the cap portion 28 at the squeeze points 44 and simultaneous rotation of the cap portion 28 it can be removed or unthreaded from the neck 18 of the container 12.

The cap portion 28 can be reapplied to the container 12 to close the opening 20 by simple rotation in a closing direction. During such rotation, the lock element 40 engages the cam surface 46 adjacent to the lock surface 42 on the lock member 26 to permit the lock element 40 to be deflected and to pass the lock member 26. When the cap portion 28 reaches its fully closed and sealed condition, the lock element 40 is circumferentially aligned with the lock surface 42 and opening movement will again require two dissimilar motions; namely, squeezing the cap portion 28 at diametrically spaced locations 44 and simultaneous rotation of the cap portion 28 in an opening direction.

The tamper indicating means 16 includes a tamper indicating element which is molded integrally to the closure 10 and can be broken away and detached. The tamper indicating element is generally T-shaped with the upper portion 52 forming a circumferential portion of the outer wall and with a depending leg portion 54 which is substantially identical to the depending lock element 40. The upper portion 52 is connected to the outer wall by a circumferential line of weakening 56 and axially extending lines of weakening 58 at opposite ends of the upper portion 52. In the closed position of the package, the depending leg portion 54 is circumferentially aligned with the surface 42 on the lock member 26 and in the fully sealed position of the closure on the container is position closely adjacent to surface 42. The tamper indicating element is also connected to the inner wall of 32 of the closure 10 by means of radially extending webs 56. The webs 56 act to maintain the inner wall 32 and outer wall 34 in fixed spaced relationship to each other in the area adjacent to the tamper indicating element 50. In this way, even though the diametrically opposed squeeze points 44 can be pressed and move the lock element radially outwardly, the tamper indicating element 50 remains circumferentially aligned with the lock surface 42 so that rotational movement of the closure 12 in an opening direction is prevented.

Opening of the package by removal of the closure 10 from the container 12 can be accomplished only by removal of the tamper indicating element 50. This is accomplished by grasping the depending portion 54 and breaking the tamper indicating element 50 from the outer wall 34 and at the same time fracturing the webs 56 to separate the tamper indicating element 50 from the inner wall 32. With the tamper indicating element 50 removed, the closure 10 can be rotated in an opening direction at least until the lock element 40 engages the lock surface 42 of the lock member 26. At that time, it becomes necessary to press the diametrically opposed squeeze points 54 so that the lock element 40 moves radially outwardly an amount sufficient to pass the lock element 46 for unthreading movement of the closure.

The absence of the tamper indicating element 50 from the closure gives immediate evidence to an observer that the package has either been opened or has been put into condition in an effort to open it and as a result, gives a warning of possible tampering.

The closure 10 can be applied to the container 12 by the usual threading action in a closing direction. For this purpose, the container is provided with a cam surface 60 immediately adjacent to the lock member 26 and the inner wall 32 of closure 10 is provided with a complementary cam surface 62 located adjacent to the tamper indicating element 50. Upon closing movement by rotating the closure 10 relative to the neck of the container 12, the cam surfaces 60 and 62 engage each other and move the tamper indicating element 50 radially outwardly a sufficient amount to pass the lock member 26. This prevents the leg portion 54 of the tamper indicating element 50 from engaging the cam surface 46 which might possibly cause separation of the lines of weakening and webs 56 and premature separation of the tamper indicating element 50 from the remainder of the closure 10.

A child resistant and tamper indicating closure and container arrangement have been provided in which the child resistant opening procedures are not effective until a tamper indicating element is removed from the closure. The absence of the tamper indicating element gives evidence that the closure has been put in a condition for prior opening and also permits the child resistant sequence of movements fo removal of the closure to be put into operation.

The embodiment of the invention in which an exclusive property or privilege is claimed are defined as follows:

1. A tamper indicating and child resistant package including a threaded closure and a container having a threaded neck to receive said closure, said package comprising: a lock member on said container, a closure having a top with concentric inner and outer walls depending from said top, said inner wall having threads engageable with said threaded neck on said container, a lock element on said outer wall for engaging said lock member upon opening rotation of said closure to prevent rotation beyond a predetermined point, said lock element being deflectable radially outwardly upon radial inward squeezing of said outer wall at diametrically opposed points to permit said lock element to pass said lock member and permit opening rotation of said closure, a tamper indicating element on said outer wall for engaging said lock member to prevent rotation of said closure in an opening direction, said tamper indicating element being frangible relative to said outer wall for removal from said closure to permit rotational movement of said closure relative to said lock member and to indicate tampering, and means connecting said tamper indicating element to said inner wall to prevent radial outward deflection of said lock element upon squeezing of said outer wall at said diametrically opposed points to prevent rotation and maintain said closure on said container until removal of said tamper indicating element.

2. The closure of claim 1 wherein said tamper indicating element has a portion forming a part of said outer wall and a portion depending from said outer wall.

3. The closure of claim 2 wherein said depending portion is generally similar to said lock element.

4. The closure fo claim 1 wherein said tamper indicating element is diametrically opposed to said lock element.

5. The closure of claim 1 wherein said means connecting said tamper indicating element to said inner wall includes a plurality of frangible elements holding said inner and outer walls in predetermined spaced relationship to each other.

6. The closure of claim 1 wherein removal of said tamper indicating element from said outer wall simultaneously fractures said frangible elements and separates said tamper indicating element from said inner wall.

7. The closure of claim 6 wherein said frangible elements are radially extending webs.

8. The closure of claim 1 wherein said tamper indicating element is disposed in close proximity to a lock member when said closure in in a normally closed position on said container.

9. The closure of claim 1 wherein said lock element and tamper indicating element are diametrically spaced from each other and are adapted to coact with separate lock members on a container.

10. The closure of claim 1 and further comprising cam means on the interior of said inner wall for coaction with complementary cam means on said container to deflect said inner wall and said tamper indicating element radially outwardly as a unit to clear said lock member when said closure is rotated in a closing direction to apply said closure to said container.

11. A tamper indicating and child resistant package including a threaded closure and a container having a threaded neck to receive said closure, said package comprising: a lock member on said container, a closure having a top with concentric inner and outer walls depending from said top, said inner wall having threads engageable with said threaded neck on said container, a lock element on said outer wall for engaging said lock member upon opening rotation of said closure to prevent rotation beyond a predetermined point, said lock element being deflectable radially outwardly upon radial inward squeezing of said outer wall at diametrically opposed points to permit said lock element to pass said lock member and permit opening rotation of said closure, a tamper indicating element on said outer wall, a second lock element depending from said tamper indicating element in circumferential alignment with said first named lock element, said tamper indicating element being frangible relative to said outer wall for removal from said closure to permit rotational movement of said closure relative to said lock member in an opening direction whereby removal of said tamper indicating element indicates the possibility of prior opening.

12. The closure of claim 11 wherein said additional lock element is diametrically disposed relative to said first mentioned lock element.

13. The closure of claim 11 wherein said tamper indicating element includes connecting webs connecting said tamper indicating element to said inner wall to prevent relative movement of said outer wall.

14. The closure of claim 13 wherein said webs are frangible for removal of said tamper indicating element from said outer wall.

15. The package of claim 11 and further comprising loading ramp means carried by said container and riding ramp means on said inner wall, said loading the riding ramp means being engageable with each other to deflect said tamper indicating element radially outwardly relative to said lock member upon rotation of said closure in a closing direction to prevent separation of said tamper indicating means from said inner and outer walls.

16. The package of claim 15 wherein said loading ramp means on said container are disposed adjacent said lock member.

17. The package of claim 15 wherein said riding ramp means are disposed on said inner wall in radial alignment with said tamper indicating means.

* * * * *